United States Patent [19]

Johnson

[11] 4,332,180

[45] Jun. 1, 1982

[54] RESAW APPARATUS

[76] Inventor: Allard R. Johnson, 909 W. Birch, Shelton, Wash. 98584

[21] Appl. No.: 93,006

[22] Filed: Nov. 9, 1979

[51] Int. Cl.[3] ..... B27B 5/00

[52] U.S. Cl. ..... 83/872; 83/422; 83/435.2; 83/874

[58] Field of Search ..... 83/872, 873, 874, 418, 83/419, 425, 425.2, 431, 432, 435, 435.2, 422

[56] References Cited

U.S. PATENT DOCUMENTS

| | | | |
|---|---|---|---|
| 799,546 | 9/1905 | Dittbenner | 83/422 |
| 1,584,796 | 5/1926 | Neal | 83/873 |
| 1,584,797 | 5/1926 | Neal | 83/873 |
| 2,676,625 | 4/1954 | Gustin | 83/431 |
| 2,710,637 | 6/1955 | Fish | 83/872 |
| 3,379,081 | 4/1968 | Firth et al. | 83/422 |
| 3,757,625 | 9/1973 | Pfenning | 83/404.1 |
| 3,832,922 | 9/1974 | Stout | 83/872 |
| 3,903,771 | 9/1975 | Fritz | 83/102.1 |
| 3,929,048 | 12/1975 | McGehee | 83/751 |
| 4,009,630 | 3/1977 | Ekholm | 83/369 |

*Primary Examiner*—James M. Meister

[57] ABSTRACT

A board or workpiece is received broad side down on an endless belt which feeds the board into a circular saw blade extending transversely above and across the endless belt. The belt is horizontal and the circular saw blade is generally horizontal for cutting the board dimensionally with respect to the surface of the conveyor belt as a "fence" or reference level. Although the board is positioned with respect to the reference level of the conveyor primarily by gravity, a hold-down wheel may be utilized for insuring the forward feed of the board toward the saw by the conveyor. The saw mount is tiltable with respect to the conveyor whereby angular sawing may also be accomplished, and the saw is also slidably adjustable with respect to its mount for setting the depth of cut. A plurality of downwardly extending dogs engage the board on the conveyor and prevent kickback by the saw.

1 Claim, 5 Drawing Figures

FIG. 3
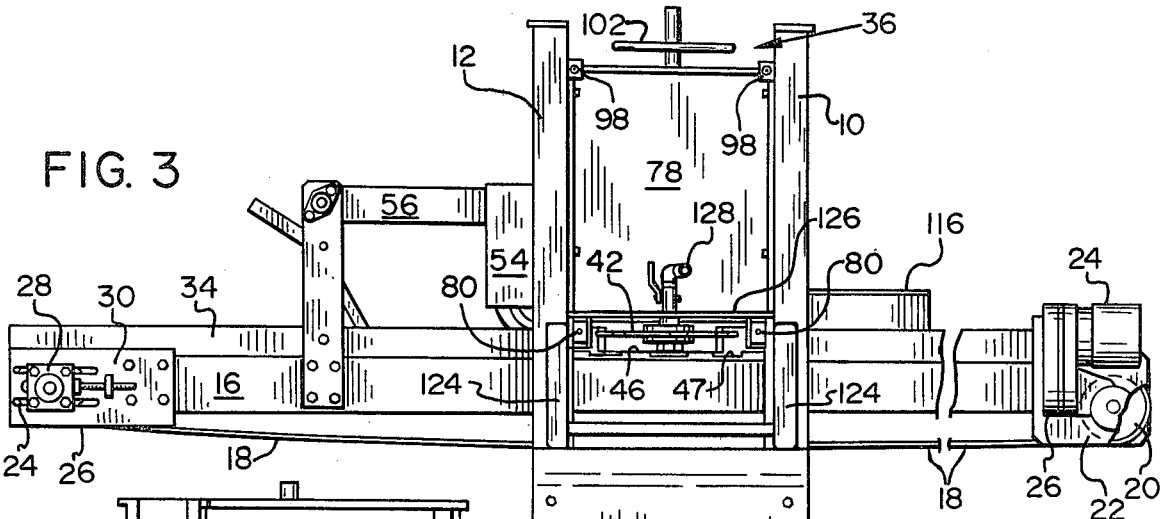
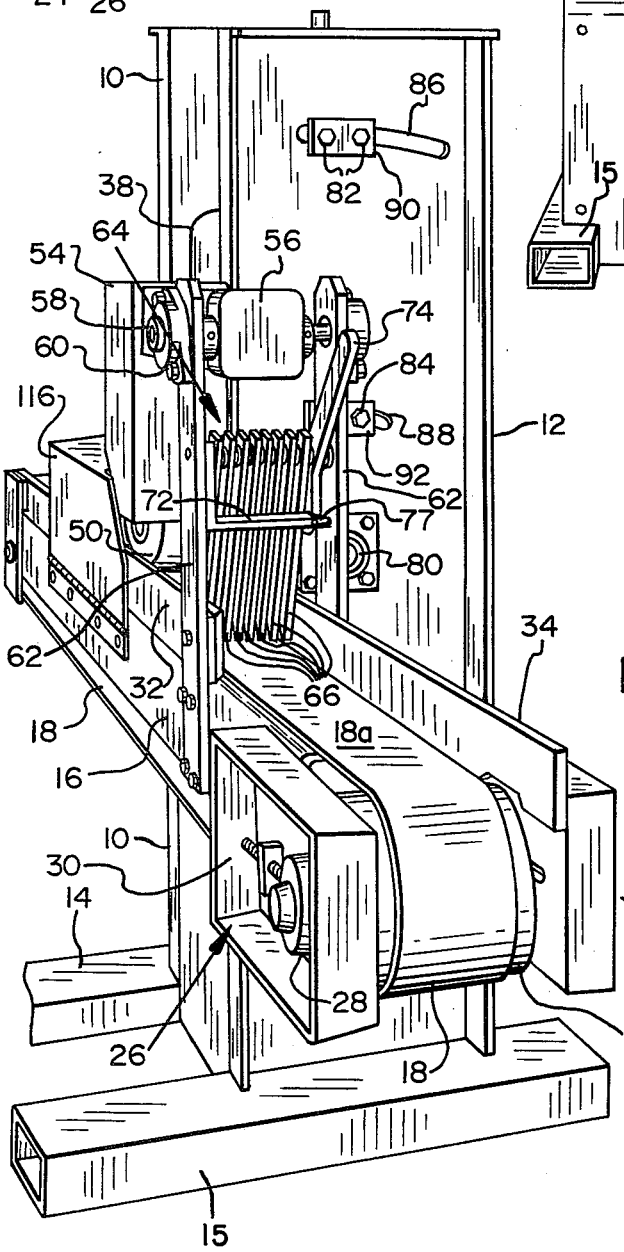
FIG. 4

RESAW APPARATUS

BACKGROUND OF THE INVENTION

The present invention relates to a resaw apparatus and particularly to such apparatus wherein mispositioning and waste of lumber is avoided and wherein sawing equipment is simplified.

In the usual resaw device, a board is conveyed by conveyor means toward a vertical saw where a holdup roll or similar device urges the board sideways against a fixed vertical reference or fence with respect to which the board is sawed. Thus, the fence is the reference with respect to which a saw cut is measured. Generally, the board will be received and conveyed on edge, as when a two-by-four is cut into two one-by-fours.

Unfortunately, since the correct dimensioning of the cut is dependent on the correct positioning and alignment of the board by the holdup roll with respect to the fence, mismanufacture occurs when the board is mispositioned and the holdup roll is unable to align the board on edge in accurate sliding relation to the fence. Furthermore, an accurate holdup roll device represents an expense in addition to the conveyor for moving the boards, the fence against which the boards are positioned, and the vertical saw.

Usually, the holdup roll which urges the board against the fence is spring loaded such that pressure, and therefore accuracy of cut, is somewhat dependent upon the thickness of the board. Moreover, friction and consequent wear on the fence takes place as innumerable boards slide therealong.

SUMMARY OF THE INVENTION

In accordance with the apparatus of the present invention, a board or workpiece is received broad side down on a horizontal, endless conveyor belt. The conveyor belt moves the board into a saw which extends transversely above and across at least a major portion of the upper reach of the endless belt, wherein the saw blade is positioned at a predetermined distance above the belt. The belt thus acts as a reference level or fence for dimensioning the cut. The system is substantially fool proof since the board or workpiece is positioned by gravity, and therefore mismanufacture and waste of lumber is avoided. It is seen the conveyor belt acts not only as the means for moving the board forwardly into the saw, but also as the fence with respect to which the saw cut is gauged.

Although the board is moved forwardly by, and the depth of cut is gauged with respect to, the conveyor belt, it is nevertheless desirable to provide means for holding the board downwardly on the conveyor whereby traction between the conveyor belt and the board is assured. This means preferably comprises a wheel which is also gravity operated and therefore not dependent upon the overall thickness of the board or workpiece in determining the pressure applied to the board.

According to another feature of the present invention, the saw blade is tiltable to some extent with respect to the conveyor belt whereby sawing at a specified angle can be accomplished.

In accordance with another feature of the invention, an anti-kickback device comprising a number of dogs is located above the conveyor and receives a board or workpiece thereunder. The forward ends of the dogs are pointed and the dogs are oriented in a direction for merely passing over the board so long as travel thereof is restricted to the direction toward the saw, but if the board tends to be "kicked back" by the saw, the pointed dogs engage the board and prevent backward movement.

It is accordingly an object of the present invention to provide an improved apparatus for resawing boards.

It is another object of the present invention to provide an improved apparatus for resawing boards more accurately and consistently to avoid mismanufacture and waste of lumber.

It is another object of the present invention to provide an improved apparatus for resawing boards employing a less complicated and less expensive structure for positioning the boards for sawing.

It is another object of the present invention to provide an improved apparatus for resawing boards in a virtually automatic manner facilitating automatic or machine feed.

It is another object of the present invention to provide an improved apparatus for resawing boards while avoiding excessive friction on component parts.

The subject matter which I regard as my invention is particularly pointed out and distinctly claimed in the concluding portion of this specification. The invention, however, both as to organization and method of operation, together with further advantages and objects thereof, may best be understood by reference to the following description taken in conjunction with the accompanying drawings wherein like reference characters refer to like elements.

DRAWINGS

FIG. 3 is an elevational view, partially broken away, of the remote side of the apparatus;

FIG. 4 is a perspective view of the apparatus according to the present invention, partially broken away, as viewed from the infeed end.

DETAILED DESCRIPTION

Figure 1:
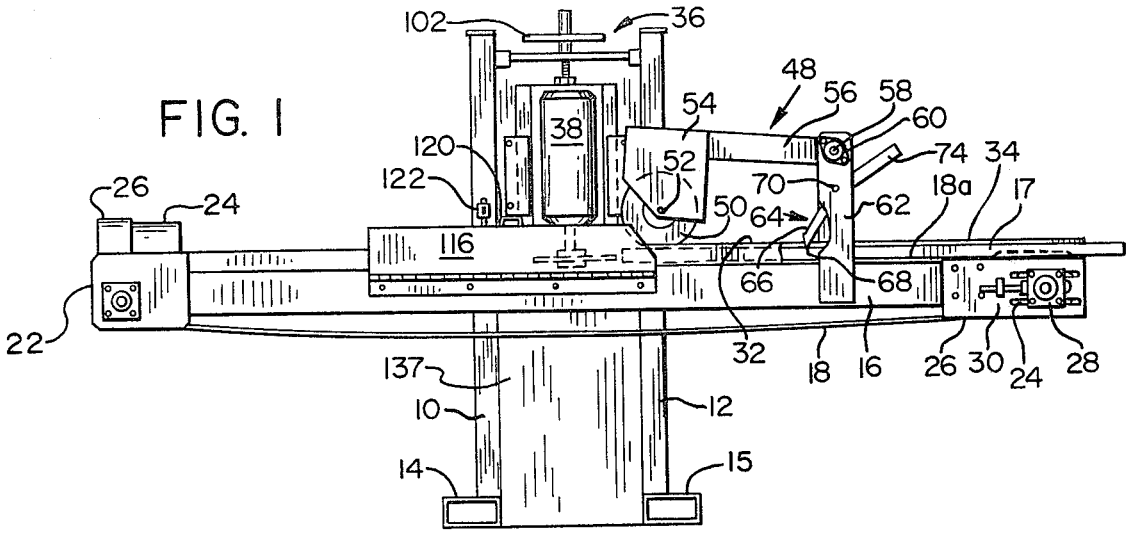
FIG. 1 is an elevational side view of resaw apparatus according to the present invention.

Referring to the drawings, showing a preferred embodiment of the invention, a frame for the resaw apparatus according to the present invention comprises vertically upstanding channel members 10 and 12 supported respectively on horizontal feet 14 and 15. The channel members 10 and 12 support the side of a horizontal beam or tube 16 having a rectangular cross section and providing an elongated horizontal table for the resaw apparatus. An endless belt 18 is trained around the ends of the tube 16 and specifically around drum 20 located at the forward end of tube 16 by belt drive assembly 22, and around drum 24 positioned at the rearward end of tube 16 by slack adjusting assembly 26. The belt drive assembly 22 includes a drive motor 24 for rotating drum 20 via adjustable reducer 26 and is controlled to move endless belt 18 at predetermined sawing speeds. Slack adjusting assembly 26 includes a slidably movable bearing 28 which is adjustable in a direction longitudinal of the tube 16 by means of a conventional screw adjustment 30. It is understood the slack adjusting assembly is duplicated on each side of the apparatus.

The endless belt 18 includes an upper reach 18*a* which slides along the top of tube 16 and provides a constant reference level or table level for boards received for resawing, said reference level being equal to the level of the top of the tube 16 plus the thickness of the belt. The belt preferably comprises a plastic material of textured form havng a multiplicity of grooves with ridges therebetween for receiving sawdust particles while maintaining the correct positioning of a board received upon the belt without the sawdust particles becoming entrained betweenthe top surface of the belt and the work on the belt.

Adjacent the edges of the upper reach of the belt are left and right side guards 32 and 34 which are positioned in upstanding, parallel, facing relation by spacers welded to tube 16. These side guards, together with the tube and belt, provide a board receiving channel into which boards such as board 17 are received lengthways onto the upper reach of the belt. As will be noted, the side guard 32 is foreshortened on the left-hand side of the machine for convenience in access to the board receiving channel. Typically, boards such as two-by-fours are received in horizontal position, broad side down, and lengthways on the belt for resawing into one-by-fours.

The upright members 10 and 12 also support a saw assembly generally designated at 36 and including a saw arbor motor 38 for rotating saw arbor 40 to which a circular saw blade 42 is attached. The saw blade is positioned in transverse relation across and above the top face of the upper belt reach 18*a*, while an aperture 44 in the left side guard and a corresponding rear opening 47 in the right side guard provide clearance for the saw blade as the blade normally extends completely across the channel. The rear side guard includes short guard members 46 extending upwardly into the rear opening 47 for passing the central hub and the teeth of the saw blade, for example when the latter is tilted downwardly as hereinafter more fully described.

Figure 2:
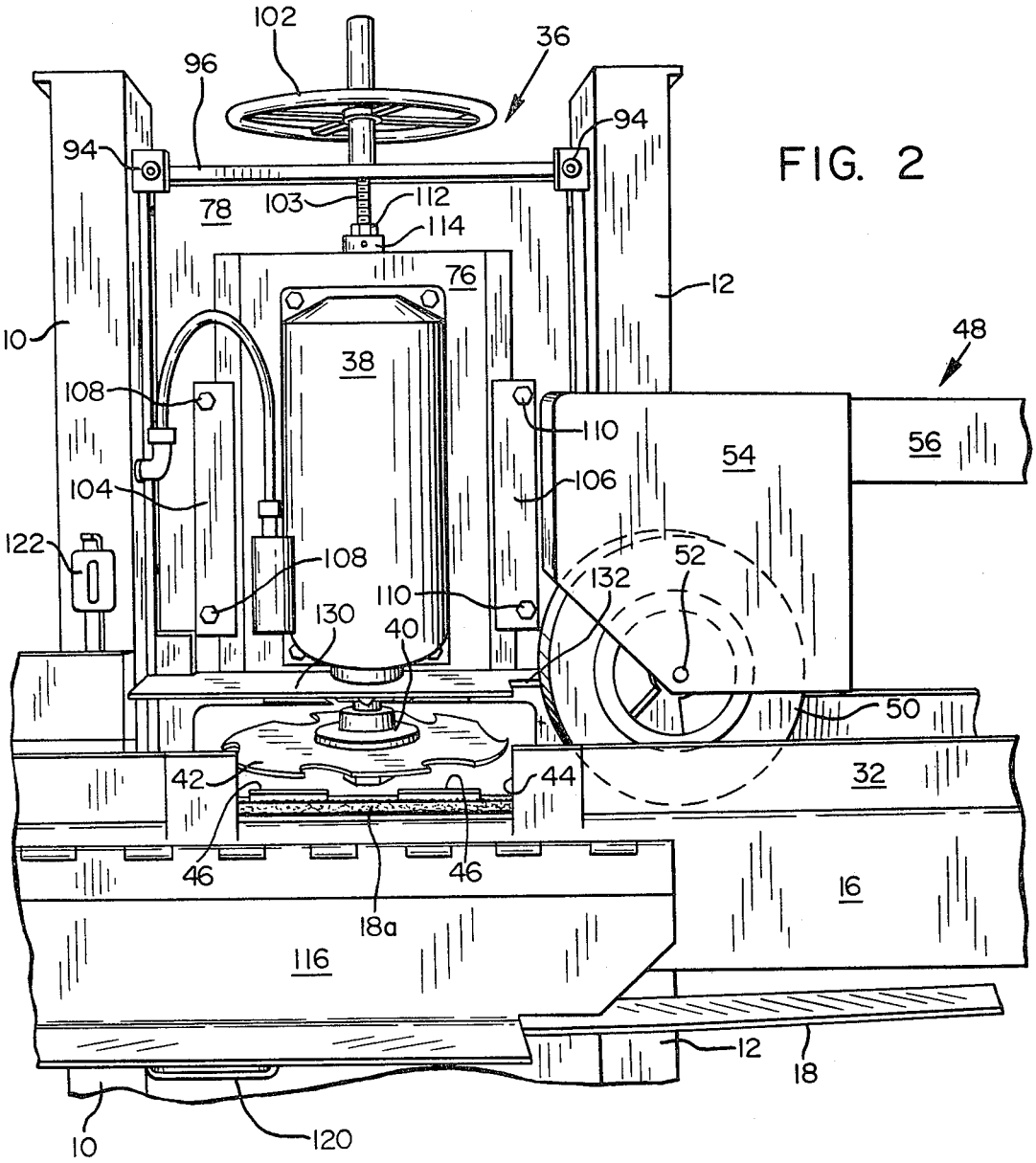
FIG. 2 is an enlarged view, partially broken away, of a portion of the FIG. 1 resaw apparatus.
Figure 5:
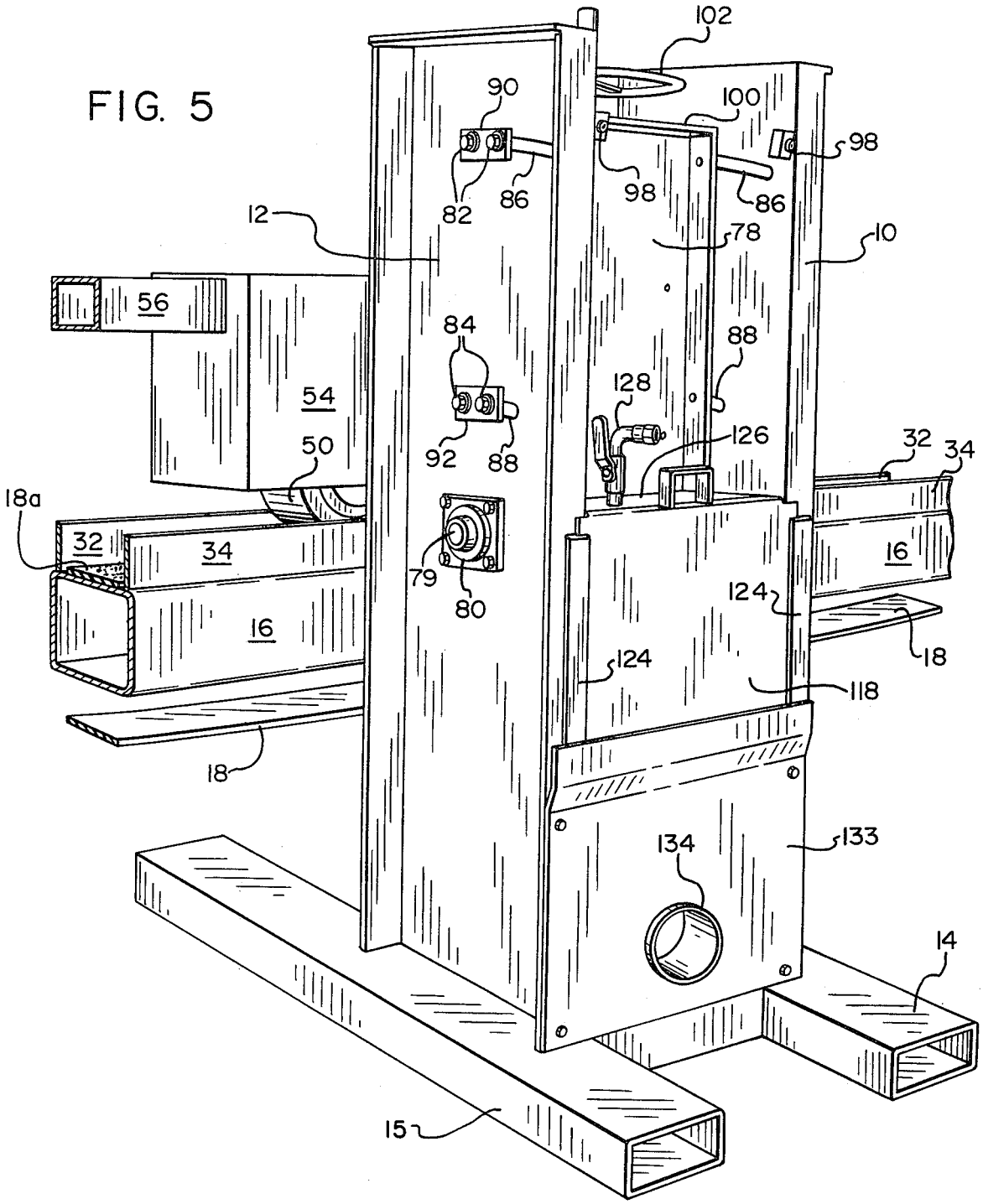
FIG. 5 is a perspective view, partially broken away and in cross section, of the resaw apparatus according to the present invention as viewed from the remote or back side.

As illustrated in FIGS. 1, 2 and 3, the saw blade normally has a horizontal orientation for making a horizontal cut in a board received upon belt 18. In such case, the side of the saw blade is accurately located in parallel justaposition above the upper face of said belt, and is spaced away from said belt by a distance to provide the proper dimension of cut for severing the board in a correct horizontal plane above the reference level of the conveyor belt. The conveyor belt thus not only transports the board or workpiece through the saw, but also acts as a "fence" or reference against which the saw cut is measured. The positioning of the board in accurate relation against this fence is accomplished primarily by gravity, although suitable hold-down means in the form of a hold-down wheel may also be supplied as hereinafter more fully described. As a consequence of gravity orientation of the workpiece, the error in resawing boards to desired dimension, as would be caused by mispositioning of the workpiece, is avoided, thereby avoiding mismanufacture and consequent waste of lumber. Furthermore, since the movable fence also acts to convey the workpiece, no frictional wear due to sliding friction results on the fence. Moreover, the resaw apparatus according to the present invention can be automatically or machine fed if desired since positioning the board against the "fence" by gravity in this manner is virtually fool proof.

Hold-down means 48, suitably positioned proximate the location of saw assembly 36, comprises a rubber tired hold-down wheel 50 mounted on a horizontal axle 52 in housing 54 disposed on the end of an arm 56. Arm 56 is secured to shaft 58 rotatable in bearings 60 which are positioned on left and right uprights 62 mounted on either side of tube 16. This mechanism, which also operates by gravity, is desirably employed for receiving a board thereunder and facilitates proper feed of the board toward the saw blade. Thus, the hold-down wheel moves up and over the board as illustrated in FIG. 1, insuring continued frictional engagement between the board and the top surface of the conveyor belt whereby the board is continuously urged forwardly. Since the hold-down wheel is gravity operated the force applied and therefore the accuracy of measurement of the cut above the top face of the conveyor "fence" is not dependent upon the thickness of the workpiece. The hold-down wheel is located proximate the forward or leading edge of the saw blade where the latter cuts the board and consequently the wheel continues to hold down the top or severed part of the board until the cut is substantially complete.

The apparatus is further provided with an anti-kickback assembly 64 for preventing kickback of material by the saw. The anti-kickback assembly comprises a plurality of angularly downwardly extending fingers or dogs 66 each having a pointed or chisel-shaped lower end 68 angularly oriented in the direction of board movement along belt 18. The dogs 66 are rotatably mounted on a shaft 70 extending between uprights 62, said shaft also rotatably mounting a U-shaped handle assembly 72 having an angularly upwardly and outwardly extending handle 74 joined thereto. In the normal, at rest position, the dogs 66 engage the front lower side of U-shaped member 72 and are held in an angular forward direction thereby, the rear of U-shaped member 72 engaging a stop 77 mounted on the right-hand upright 62. When a board passes under the dogs 66, the dogs will be upraised slightly allowing the board to pass thereunder. However, should the saw tend to kick the board backwards, the pointed ends 68 will engage the top surface of the board and prevent this from occurring. Handle 74 can be employed for urging the dogs upwardly out of the way as for disengaging the dogs from a board in an appropriate situation.

Further considering saw assembly 36, saw arbor motor 38 is secured to normally vertically oriented motor base plate 76 with the motor shaft extending downwardly to receive saw arbor 40. The base plate 76 and the motor carried thereby are mounted above the level of the upper reach of the conveyor upon tiltable arbor motor mounting plate 78 provided at its lower corners with pivot members 79 journaled in bearings 80 located on upstanding channel members 10 and 12 such that the arbor mounting plate is rotatable with respect to an axis above and parallel to the conveyor belt. In its normal or vertically upright position, arbor motor mounting plate 78 is held in position by upper and lower cap screws 82 and 84 which extend through arcuate slots 86 and 88 in upstanding channel members 10 and 12. The cap screws threadably engage edge flanges of plate 78, while small bearing plates 90 and 92 are interposed between the cap screw heads and the slots.

The arbor motor mounting plate 78 may be tilted to a different angular orientation by first loosening cap screws 82 and 84 and urging the top of the mounting plate rearwardly after which the cap screws are retightened. As the mounting plate 78 tilts rearwardly, loosened cap screws 82 and 84 of course slide rearwardly along arcuate slots 86 and 88 as plate 78 turns about the axis of pivot members 79 in bearings 80. As will be observed, the saw arbor motor and the saw blade will be positioned thereby at an angle with respect to the horizontal whereby the saw blade can make angular cuts across the board being fed on conveyor belt 18. In the upright position for horizontal sawing, the mounting plate 78 was positioned against adjusting set screws 94 mounted on tabs extending inwardly from channel members 10 and 12, wherein said set screws engage the forward edge flange 96 of mounting plate 78. A rearward tilt position may be determined by rearward adjusting set screws 98 mounted on tabs extending inwardly from channel members 10 and 12 and adapted for positioning edge flange 100 at the top rear of mounting plate 78 for a predetermined annular sawing position. In particular, adjusting set screws 98 may be adjusted for locating saw blade 42 at an angle of eleven and one-half degrees for bevel resawing of a two-by-four. Of course, other angular positions can also be selected.

The saw is adjustable in a vertical direction to adjust for depth of cut by means of handwheel 102 having a threaded lower shaft 103 passing through a hole in top flange 96 of mounting plate 78. Lower shaft 103 has a threaded connection with riser block 114 mounted to base plate 76 for moving the latter. The base plate 76 is normally held against mounting plate 78 by a pair of gib blocks 104 and 106 which engage the edges of the base plate and which are secured by cap screws 108 and 110 respectively to mounting plate 78, the cap screws having a threaded connection with the mounting plate. To change the vertical adjustment of the saw blade to adjust the depth of cut relative to the top face of the conveyor belt, the cap screws 108 and 110 must first be loosened. Also jam nut 112 which normally locks the threaded shaft of the handwheel against riser block 114, is loosened. Then handwheel 102, the upper shaft of which bears against flange 96, is rotated whereby the base plate 76 is lowered or raised. When the desired position is attained, jam nut 112 as well as cap screws 108 and 110 are retightened. A key and guideway sliding connection (not shown) is also suitably provided between the base plate and the mounting plate to assure vertically aligned movement of the saw arbor motor.

For safety reasons, the resaw apparatus according to the present invention is provided with forward and rearward saw guards 116 and 118 for covering the openings 44 and 47 which provide clearance for the saw blade on either side of the sawing channel. The front saw guard 116 is L-shaped in cross section and extends up over the saw blade. It is hingedly connected to one side of tube 16 and may be rotated downwardly out of the way by means of handle 120, for instance when it is desired to adjust the saw for depth of cut. Normally, the front saw guard is held in its upper position by means of latch 122. Rear saw guard 118 is slidably received between spacers 124 located at the rear edges of channel members 10 and 12 adjacent the saw blade and above a bent out portion of lower rear panel 133. The top of the saw compartment in this area is closed off by a rear horizontal deck 126 extending rearwardly from the arbor motor mounting plate 78 and through which a water connection 128 may be mounted to provide coolant or lubricant to the saw blade as needed. The lower end or motor mounting plate 76 is also provided with a forwardly oriented horizontal sawdust guard 130 through which the shaft of motor 38 extends, said horizontal sawdust guard also being formed with a lower cutout opening 132 for cleaning hold-down wheel 50. The lower part of the space between upright channel members 10 and 12 and between lower front panel 137 and rear panel 133 is enclosed and suitably supplied with a blower hookup 134 for removing sawdust.

Although one saw blade has been illustrated for making one cut in a board or workpiece, it is readily apparent a plurality of saw blades can be simultaneously operated, e.g. mounted from the same shaft, for making multiple cuts across the board or workpiece if so desired.

While I have shown and described a preferred embodiment of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. Resaw apparatus comprising:

an elongated horizontal conveyor in the form of an endless belt for receiving and supporting boards in a horizontal position lengthways of said belt with a broad side of each board down, means for supporting said endless belt to position its upper face at a predetermined reference level, said supporting means comprising an elongated beam member immediately adjacent and underneath the upper reach of said endless belt along which the upper reach of said belt slides for establishing the reference level of said belt, said beam being provided with a pair of stationary and substantially planar side guards positioned in upstanding, parallel, facing relation on either side of said belt to form a board receiving channel together with said beam and said belt within which boards are received, a circular saw located along said belt, and means for moving said belt in a longitudinal direction for moving said boards lengthways into said circular saw, said circular saw having a blade extending transversely above the upper reach of said endless belt, said blade being positioned at a level for cutting a board transversely with respect to the upper face of said belt as a reference level while said belt urges said board lengthways within said channel into said saw blade beginning with one end of said board, said blade extending completely across said channel with each of said side guards having an aperture in alignment with said blade for receiving said blade adapting a board to slidably engage one of said side guards while being cut, and a gravity operated wheel proximate the position of said saw for bearing on the top surface of a board as received in said channel for holding said board in a direction downwardly toward the upper face of said belt, said apparatus including a substantially upstanding arbor for supporting said saw blade and power means for rotating said arbor, said power means comprising a motor positioned above the level of the upper reach of said belt and having a shaft extending downwardly to which said arbor is secured, said apparatus further including a base plate to which said motor is attached and a tiltable mounting plate slidably receiving said base plate in vertically adjustable position for adjusting the depth of cut of said saw relative to said belt, said apparatus having a frame, said mounting plate being provided with pivoting means proximate the lower end thereof journaled for pivoting said mounting plate upon said frame about an axis parallel to said board receiving channel and disposing said mounting plate and said base plate in generally parallel relation to said board receiving channel, and means on said frame above said pivoting means for releasably securing said mounting plate in a selected angular position for disposing said saw blade in selected angular position for making angular cuts in boards received in said channel.

* * * * *

UNITED STATES PATENT AND TRADEMARK OFFICE

CERTIFICATE OF CORRECTION

PATENT NO. : 4,332,180

DATED : June 1, 1982

INVENTOR(S) : ALLARD R. JOHNSON

It is certified that error appears in the above—identified patent and that said Letters Patent is hereby corrected as shown below:

Col. 2, line 29 , "conjunction" should be --connection--.

Col. 3, line 13 , "betweenthe" should be --between the--.

Col. 5, line 68 , "or" should be --of--.

Col. 6, line 4 , "cleaning" should be --clearing--.

Signed and Sealed this

*Twenth-eighth* Day of *September 1982*

[SEAL]

*Attest:*

GERALD J. MOSSINGHOFF

*Attesting Officer* *Commissioner of Patents and Trademarks*